US006618887B2

(12) United States Patent
Kim et al.

(10) Patent No.: US 6,618,887 B2
(45) Date of Patent: Sep. 16, 2003

(54) DRAWER-TYPE WASHING MACHINE AND PROCESS OF WASHING LAUNDRY USING THE SAME

(75) Inventors: Hyoun Jin Kim, Seoul (KR); Dong Won Kim, Kwangmyung-si (KR); Young Hwan Park, Kwangmyung-si (KR); Yong Chul Kim, Seongnam-si (KR); Si Moon Jeon, Seoul (KR); Byung Keol Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 09/895,083

(22) Filed: Jul. 2, 2001

(65) Prior Publication Data

US 2002/0042957 A1 Apr. 18, 2002

(30) Foreign Application Priority Data

| | | |
|---|---|---|
| Oct. 12, 2000 | (KR) | 2000-60116 |
| Dec. 15, 2000 | (KR) | 2000-77245 |
| Dec. 19, 2000 | (KR) | 2000-78459 |
| Nov. 22, 2000 | (KR) | 2000-69648 |

(51) Int. Cl.[7] ..... D06F 37/20

(52) U.S. Cl. ..... 8/158; 8/159; 68/3 R; 68/23.1; 68/27

(58) Field of Search ..... 68/13 R, 23.1, 68/3 R, 26, 27; 312/228; 8/158, 159

(56) References Cited

U.S. PATENT DOCUMENTS 2,570,529 A * 10/1951 Dolan
2,668,091 A * 2/1954 Clark
3,216,226 A * 11/1965 Alger et al.
3,545,235 A * 12/1970 Menk
4,680,948 A * 7/1987 Rummel et al.
5,470,142 A * 11/1995 Sargeant et al.

FOREIGN PATENT DOCUMENTS

JP 8-192000 * 7/1996
JP 2000-93685 * 4/2000

* cited by examiner

*Primary Examiner*—Frankie L. Stinson
(74) *Attorney, Agent, or Firm*—Birch, Stewart, Kolasch & Birch, LLP

(57) ABSTRACT

A drawer-type washing machine and process of washing laundry using the washing machine is disclosed. The washing machine has a housing opened at its front to form a cavity. A cabinet, opened at its top, is received in the cavity of the housing such that the cabinet is movable forward or backward relative to the housing. A washing tub unit, consisting of an outer tub and an inner tub, is set within the cabinet. This washing tub unit contains washing water therein, and carries out both a washing operation and a spin-drying operation for laundry contained therein. A drive unit is installed at a position under the outer tub of the washing tub unit, and rotates the inner tub of the washing tub unit. A suspension unit supports the washing tub unit within the cabinet while performing a damping function of attenuating operational vibrations of the washing tub unit. A sliding unit is provided at a movable junction of the housing and the cabinet for allowing a linear sliding movement of the cabinet relative to the housing. In the washing machine, the cabinet is designed to be drawn forward and pushed backward, thus allowing a user to easily put laundry into or take laundry out of the washing tub unit. The washing machine of this invention is also easily installed on a desired area without being critically limited by the vertical space above the top of the washing machine.

20 Claims, 11 Drawing Sheets

DRAWER-TYPE WASHING MACHINE AND PROCESS OF WASHING LAUNDRY USING THE SAME

BACKGROUND OF THE INVENTION

1. Field of the Invention

The present invention relates to washing machines and, more particularly, to a drawer-type washing machine provided with a washing tub unit designed to be opened or closed through a drawer-type moving action, thus allowing a user to easily put laundry into or take laundry out of the washing tub unit and being easily installed without being critically limited by vertical space above an installation area, and effectively washing a variety of laundries having different fabric characteristics and colors at the same time, in addition to efficiently washing a small quantity of laundry while conserving water, the present invention also relating to a process of washing laundry using such a washing machine.

2. Description of the Prior Art

FIG. 1 is a sectional view, showing the construction of the conventional upright washing machine.

As shown in the drawing, the conventional upright washing machine has a housing 2, which forms the exterior of the washing machine and is provided with an openable cover 1 at its top opening. A washing tub unit 5 is set within the housing 2, and consists of two tubs: an outer tub 3 and a perforated inner tub 4. The outer tub 3 contains washing water therein, while the perforated inner tub 4 is rotatably and concentrically set within the outer tub 3, and carries out both a washing operation and a spin-drying operation for laundry contained therein. A drive unit 6 is installed at a position under the outer tub 3 of the washing tub unit 5 within the bottom portion of the housing 2, and rotates the inner tub 4 at predetermined speeds. A plurality of suspension rods 7 support the outer tub 3 within the housing 2 while performing a damping function of attenuating operational vibrations of the washing tub unit 5 during an operation of the washing machine.

However, such a conventional upright washing machine is problematic in that it forces a user to put laundry into or take laundry out of the inner tub of the washing tub unit through the top opening of the housing after opening the top cover, thus being inconvenient to the user.

In addition, the upright washing machine has one washing tub unit, and so it forces a user to sort the laundries into several groups in accordance with different fabric characteristics and colors of the laundries prior to separately washing the laundry groups through two or more operation cycles, thus undesirably lengthening the washing time, in addition to excessively consuming water while washing the laundries.

Another problem experienced by the conventional upright washing machine resides in that it is necessary to secure sufficiently large vertical space above the top of the washing machine so as to allow a user to put laundry into or take laundry out of the washing tub unit through the top opening without being interfered by surrounding fixtures. The upright washing machine is thus critically limited in the vertical space above its installation area.

SUMMARY OF THE INVENTION

Accordingly, the present invention has been made keeping in mind the above problems occurring in the prior art, and an object of the present invention is to provide a drawer-type washing machine, of which the washing tub unit is contained in a cabinet designed to be drawn forward and pushed backward in the same manner as that of a conventional drawer, thus allowing a user to easily put laundry into or take laundry out of the washing tub unit.

Another object of the present invention is to provide a drawer-type washing machine, which has a plurality of washing tub units, thus allowing a user to simultaneously and separately wash several groups of laundries sorted in accordance with their fabric characteristics and colors, and which thus saves time during a washing process and is improved in its washing effect.

A further object of the present invention is to provide a drawer-type washing machine, which has an attractive appearance, in addition to being easily installed on a desired area without being critically limited by the vertical space above the area.

Still another object of the present invention is to provide a drawer-type washing machine, which effectively performs a washing process while conserving water, and reduces the amount of waste water, thus being less likely to cause environmental pollution, particularly, water pollution.

Still another object of the present invention is to provide a drawer-type washing machine, which is designed to automatically discharge vapor from the interior of the washing tub unit when pressure inside the washing tub unit is increased higher than a reference level, thus preventing unexpected breakage of the washing tub unit due to excessive pressure.

Still another object of the present invention is to provide a process of washing laundry using such a drawer-type washing machine.

In order to accomplish the above objects, the present invention provides a drawer-type washing machine, comprising: a housing opened at its front to form a cavity; a cabinet opened at its top and received in the cavity of the housing such that the cabinet is movable forward or backward relative to the housing; a washing tub unit consisting of an outer tub and an inner tub, and set within the cabinet, the washing tub unit containing washing water therein, and carrying out both a washing operation and a spin-drying operation for laundry contained therein; a drive unit installed at a position under the outer tub of the washing tub unit, and rotating the inner tub of the washing tub unit; a suspension unit used for supporting the washing tub unit within the cabinet while performing a damping function of attenuating operational vibrations of the washing tub unit; and a sliding unit provided at a movable junction of the housing and the cabinet for allowing a linear sliding movement of the cabinet relative to the housing.

In an embodiment, the interior of the housing is partitioned into two or more cavities by at least one partition wall, with two or more cabinets each having a washing tub unit therein and respectively received in the two or more cavities of the housing.

In such a case, the washing machine may have a first water feeding pipe used for feeding water to an upper washing tub unit received in the upper cabinet; a first water draining pipe used for draining water from the upper washing tub unit; a second water feeding pipe used for feeding water to a lower washing tub unit received in the lower cabinet; a second water draining pipe used for draining water from the lower washing tub unit; a first connection hose connecting the second water draining pipe to the first water feeding pipe; a second connection hose connecting the first water draining pipe to the second water feeding pipe; a first flow control device for selectively draining processed water from a rinsing operation of the upper washing tub unit to the atmosphere through the first water draining pipe or feeding the processed water from the upper washing tub unit to the lower washing tub unit through the second connection hose; and a second flow control device for selectively draining processed water from a rinsing operation of the lower washing tub unit to the atmosphere through the second water draining pipe or feeding the processed water from the lower washing tub unit to the upper washing tub unit through the first connection hose.

In another embodiment, the washing machine also has a pressure sensor used for sensing pressure inside the washing tub unit; a vapor exhaust port mounted to the top of the washing tub unit such that the port communicates with the interior of the washing tub unit, thus selectively discharging vapor from the washing tub unit to the atmosphere; a solenoid valve mounted to the vapor exhaust port and used for controlling the port; and a controller used for controlling the solenoid valve to open the vapor exhaust port when the pressure of the washing tub unit sensed by the pressure sensor is equal to or higher than a reference level.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
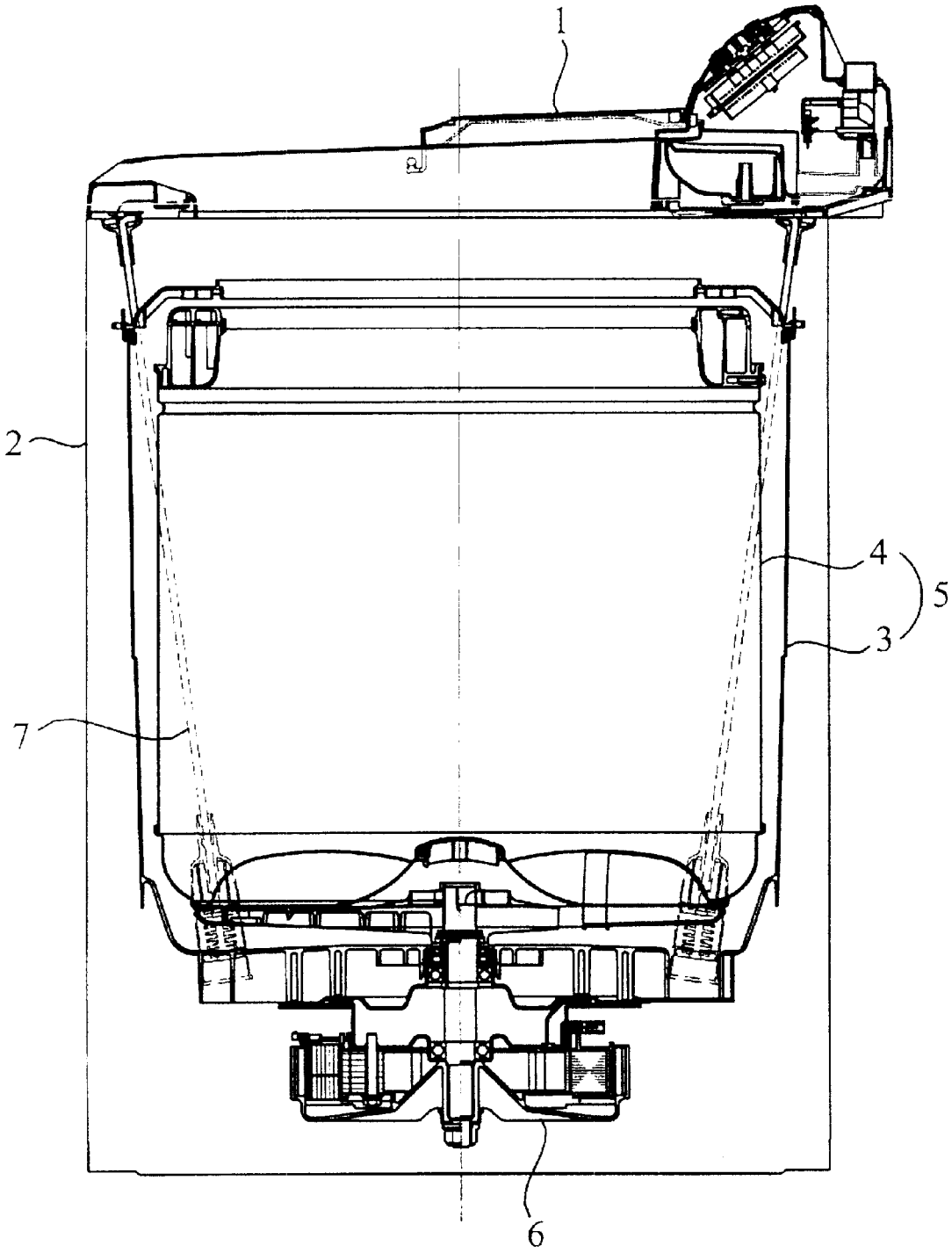
FIG.1(Prior Art)
FIG. 1 is a sectional view, showing the construction of the conventional upright washing machine.

Reference now should be made to the drawings, in which the same reference numerals are used throughout the different drawings to designate the same or similar components.

Figure 2:
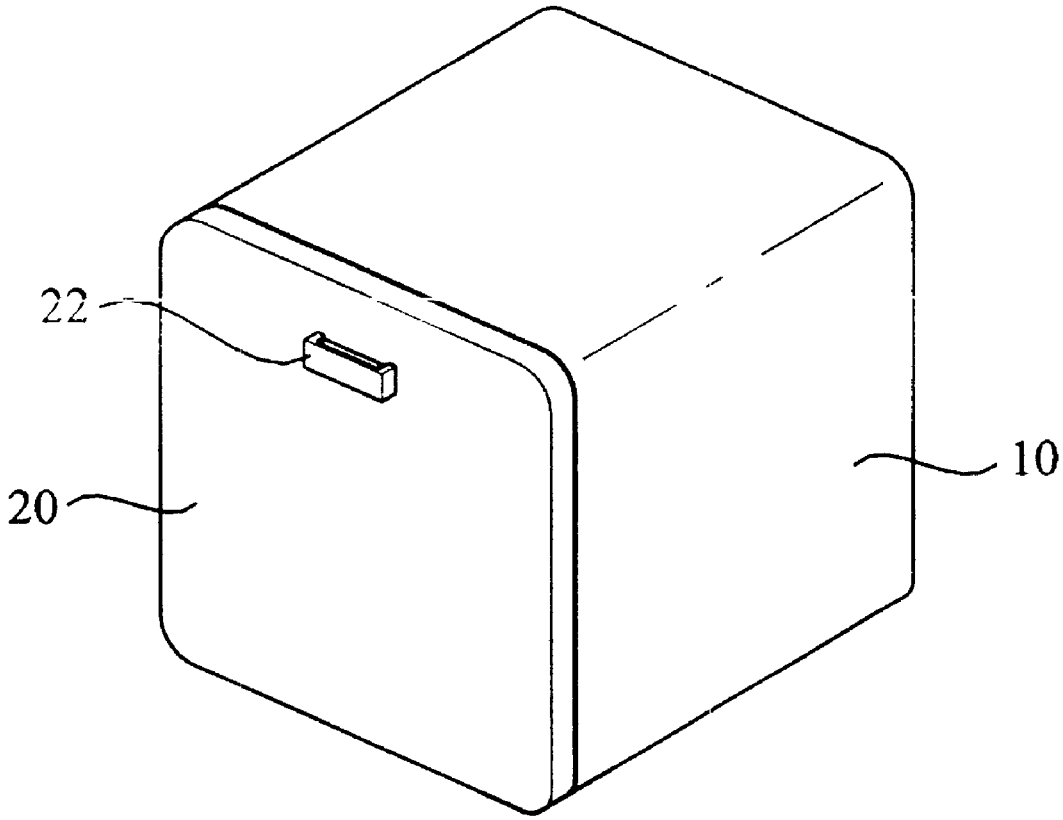
FIG. 2 is a perspective view, showing the appearance of a drawer-type washing machine in accordance with the primary embodiment of the present invention.
Figure 3:
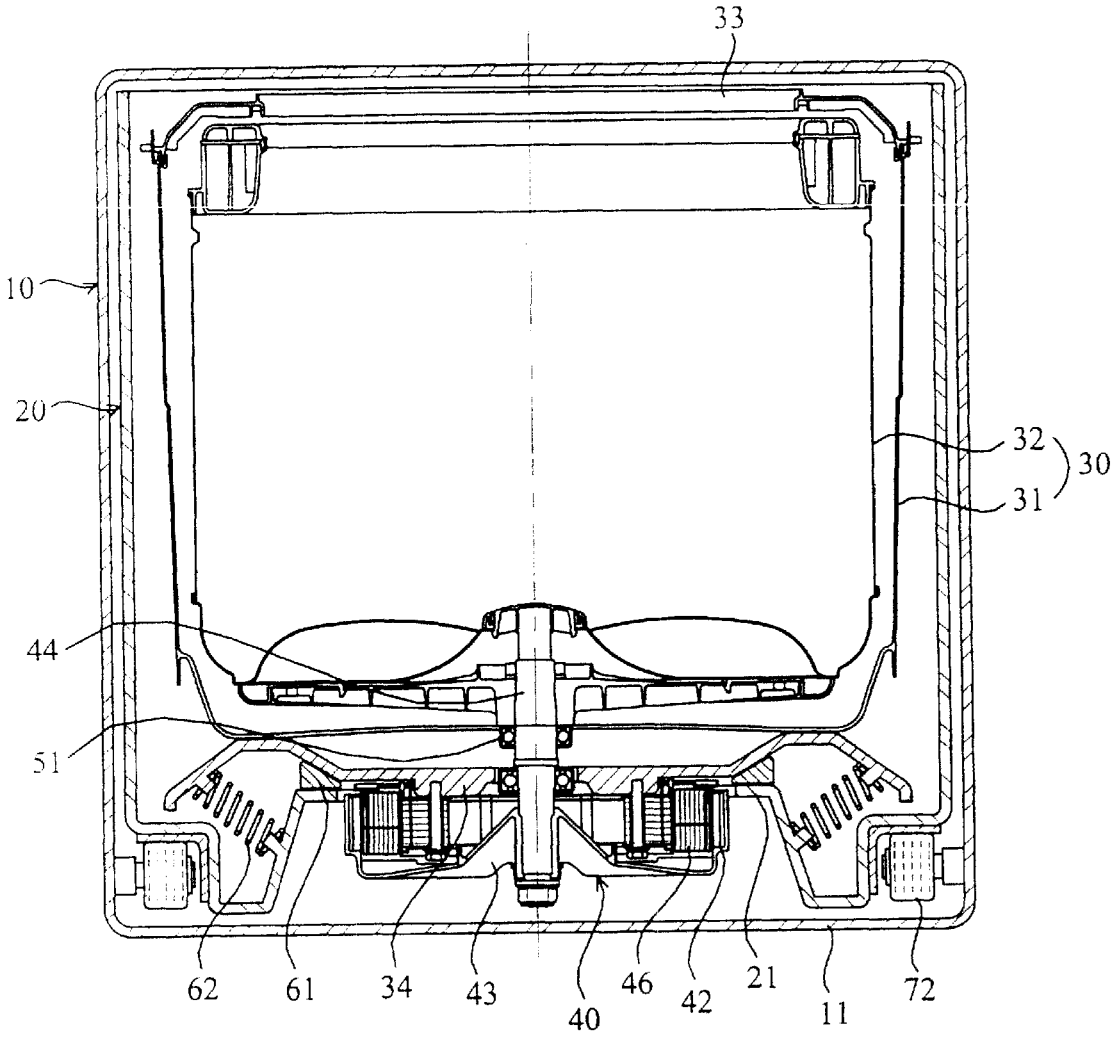
FIG. 3 is a sectional view, showing the construction of the drawer-type washing machine of FIG. 2.
Figure 4:
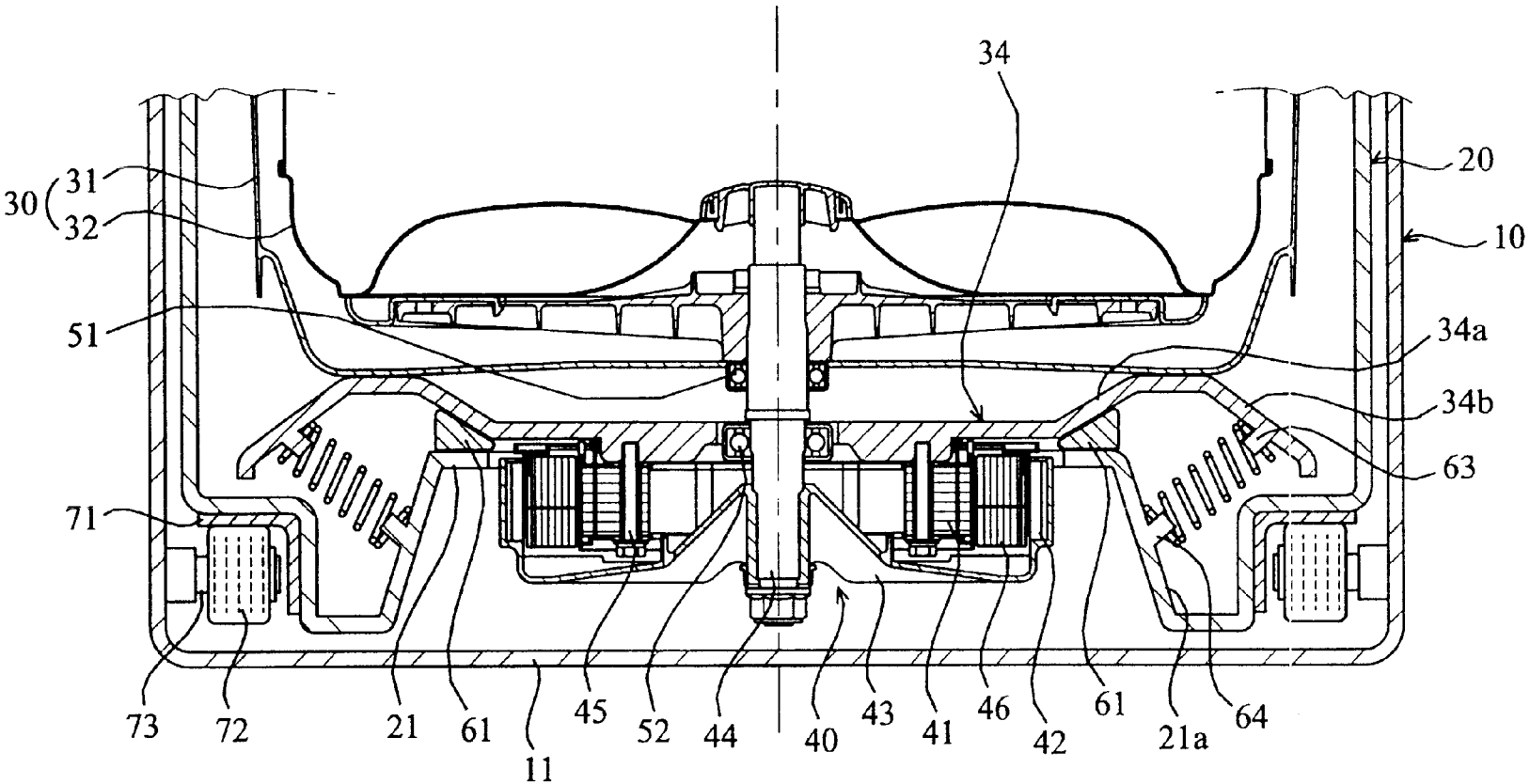
FIG. 4 is a sectional view, showing the construction of both a drive unit and a suspension unit included in the drawer-type washing machine of FIG. 2.

FIGS. 2 to 4 show a drawer-type washing machine in accordance with the primary embodiment of the present invention.

As shown in the drawings, the drawer-type washing machine of this invention has a housing 10, which forms the exterior of the washing machine and is open at its front to form a cavity. A box-shaped cabinet 20, opened at its top, is received in the cavity of the housing 10 such that the cabinet is movable forward or backward relative to the housing 10. A washing tub unit 30, consisting of an outer tub 31 and a perforated inner tub 32, is set within the cabinet 20. The outer tub 31 contains washing water therein, while the inner tub 32 is rotatably and concentrically set within the outer tub 31, and carries out both a washing operation and a spin-drying operation for laundry contained therein. A drive unit 40 is installed at a position under the outer tub 31 of the washing tub unit 30 within the bottom portion of the cabinet 20, and rotates the inner tub 32 at predetermined speeds. A suspension unit is provided at a position between the bottom walls of both the outer tub 31 and the cabinet 20, and supports the outer tub 31 within the cabinet 20 while performing a damping function of attenuating operational vibrations of the washing tub unit 30 during an operation of the washing machine. In order to allow a linear sliding movement of the cabinet 20 relative to the housing 10, a sliding unit is provided at the movable junction of the housing 10 and the cabinet 20.

In addition, the washing machine of this embodiment is provided with both a water feeding unit (not shown) and a water draining unit (not shown) in the same manner as that of conventional upright washing machines. Of course, the water feeding unit is used for feeding water from a water supply source to the washing tub unit 30, while the water draining unit is used for draining water from the washing tub unit 30 to the atmosphere.

The housing 10 is cube-shaped, with the front end of the housing 10 being opened. The front wall of the cabinet 20 acts as the door for the front opening of the housing 10, and has a handle 22.

The washing tub unit 30 has an openable cover 33 at its top. A support plate 34 is mounted to the outside surface of the bottom wall of the outer tub 31 through, for example, a welding process so as to support the washing tub unit 30 within the cabinet 20.

The support plate 34 is a disc-shaped member, with the drive unit 40 mounted to the lower surface of the support plate 34. The outer edge of the disc-shaped support plate 34 is primarily inclined upward and outward to form an upward inclined surface 34*a* terminated at a ridge, and is secondarily inclined from the ridge downward and outward to form a downward inclined surface 34*b*.

The drive unit 40 is an outer rotor-type drive unit, and consists of a stator 41, a rotor 42, a rotor core 43, and a drive shaft 44. The stator 41 is mounted to the lower surface of the support plate 34 using a plurality of locking bolts 45, with a coil 46 wound around the stator 41. The rotor 42 is arranged around the stator 41 while being regularly spaced apart from the outside edge of the stator 41. The rotor core 43 holds the rotor 42. The drive shaft 44 is fixed to the center of the rotor core 43 at its lower end, and to the inner tub 32 at its upper end.

The drive shaft 44 penetrates the center of the support plate 34, and passes through the center of the bottom wall of the outer tub 31, with a first bearing 51 positioned at the junction of the shaft 44 and the outer tub 31 to rotatably hold the shaft 44 relative to the outer tub 31, prior to reaching the bottom wall of the inner tub 32. In such a case, the junction of the outer tub 31 and the shaft 44 is sealed to prevent a leakage of water from the outer tub 32 through the junction.

A second bearing 52 is positioned at the junction of the support plate 34 and the shaft 44 to rotatably hold the shaft 44 relative to the support plate 34.

The suspension unit includes a damper 61 and a plurality of elastic suspension members 62. The damper 61 is positioned between the support plate 34 and the bottom wall 21 of the cabinet 20, and supports the washing tub unit 30 within the cabinet 20 while absorbing vibrations of the washing tub unit 30. The elastic suspension members 62 support the washing tub unit 30 within the cabinet 20 while absorbing vibrations of the washing tub unit 30, and allows the washing tub unit 30 to elastically restore its upright position when the tub unit 30 is inclined relative to the vertical axis of the cabinet 20.

In a detailed description, the damper 61 is closely positioned between the upward inclined surface 34*a* of the support plate 34 and the bottom wall 21 of the cabinet 20, and supports the washing tub unit 30 within the cabinet 20 while allowing a desired displacement of the tub unit 30 during an operation of the washing machine. This damper 61 is an annular elastic body. That is, the damper 61 is opened at its center, and is inclined upward at its upper surface to meet the inclined surface 34*a* of the support plate 34, and is flat at its lower surface coming into contact with the bottom wall 21 of the cabinet 20.

In the primary embodiment, each of the elastic suspension members 62 is a coil spring, which is seated on the downward inclined surface 34*b* of the support plate 34 and an inclined surface 21*a* of the cabinet's bottom wall 21 at its upper and lower ends respectively while being inclined at an angle of inclination.

That is, the upper end of each elastic suspension member 62 is fitted over a first spring seat 63 provided at the downward inclined surface 34*b* of the support plate 34, while the lower end of the member 62 is fitted over a second spring seat 64 provided on the inclined surface 21*a* of the cabinet's bottom wall 21.

The sliding unit, used for allowing a linear sliding movement of the cabinet 20 relative to the housing 10, comprises two guide rails 71 and a plurality of rollers 72. The two guide rails 71 extend from the front to the back along the opposite side edges of the cabinet's bottom wall 21. The rollers 72 are rotatably mounted to the same number of roller shafts 73, interiorly mounted to the lower portions of the opposite sidewalls of the housing 10, thus forming two rows of rollers. The two rails 71 are movably seated on the two rows of rollers 72, thus allowing the cabinet 20 to be linearly movable relative to the housing 10 under the guide of the rollers 72.

In order to put laundry into the inner tub 32 of the washing tub unit 30 prior to starting a washing process using the washing machine, a user primarily draws the cabinet 20 forward from the housing 10 while gripping the handle 22 of the cabinet 20 with a hand. In such a case, the cabinet 20 is smoothly movable forward from the housing 10 under the guide of the rollers 72. After the cabinet 20 is fully drawn forward from the housing 10, the cover 33 is opened prior to putting laundry into the inner tub 32. Thereafter, the cover 33 is laid on the top of the washing tub unit 30 prior to fully pushing the cabinet 20 backward into the cavity of the housing 10.

After washing water is fed into the washing tub unit 30, the drive unit 40 is turned on to rotate the shaft 44 along with the inner tub 32. The washing machine thus performs a washing process consisting of a washing step, a rinsing step and a spin-drying step. During such a washing process, the damper 61 of the suspension unit supports the washing tub unit 30 within the cabinet 20 while allowing a displacement of the tub unit 30 within a predetermined range. The elastic suspension members 62 elastically support the washing tub unit 30 while attenuating vibrations of the washing tub unit 30 by their elasticity.

Figure 5:
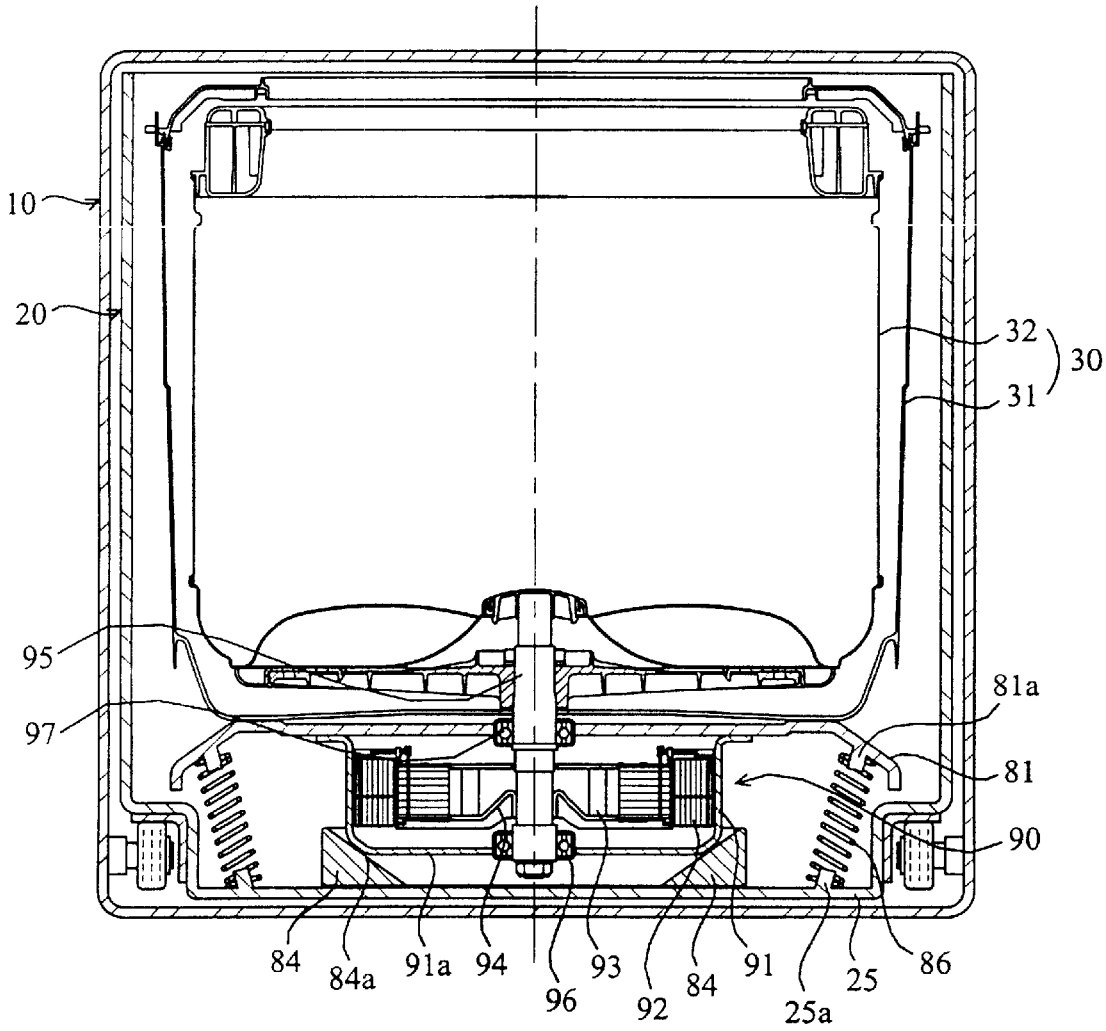
FIG. 5 is a sectional view, showing the construction of a drawer-type washing machine in accordance with the second embodiment of the present invention.

FIG. 5 is a sectional view, showing the construction of a drawer-type washing machine in accordance with the second embodiment of the present invention.

In the washing machine of this second embodiment, a support plate 81 is mounted to the outside surface of the bottom wall of the outer tub 31 of the washing tub unit 30 through, for example, a welding process so as to support the washing tub unit 30 within the cabinet 20. A suspension unit is provided at a position between the bottom wall of the outer tub 31 and the bottom wall 25 of the cabinet 20, and supports the outer tub 31 within the cabinet 20 while performing a damping function during an operation of the washing machine. A drive unit 90 of the inner rotor-type is installed at a position under the support plate 81 within the cabinet 20.

The support plate 81 has a disc shape, and is fixed to the bottom wall of the outer tub 31 at its upper surface, with a drive shaft 95 of the drive unit 90 rotatably passing through the center of the support plate 81.

The drive unit 90 has a motor housing 91 fixed to the lower surface of the support plate 81. The drive unit 90 also has a stator 92, a rotor 93, a rotor core 94, and a drive shaft 44. The stator 92 is fixed to the inner surface of the sidewall of the motor housing 91, with a coil wound around the stator 92. The rotor 93 is arranged inside the stator 92 while being regularly spaced apart from the inside edge of the stator 92. The rotor core 94 holds the rotor 93, with the drive shaft 95 fitted into and fixed to the center of the rotor core 94.

The drive shaft 95 penetrates the bottom wall 91*a* of the motor housing 91 at its lower end, with a first bearing 96 positioned at the junction of the shaft 95 and the bottom wall 91*a* of the motor housing 91 to rotatably hold the shaft 95 relative to the motor housing 91. The shaft 95 also penetrates the support plate 81 at its middle portion, with a second bearing 97 positioned at the junction of the shaft 95 and the support plate 81. This shaft 95 is finally fixed to the bottom wall of the inner tub 32.

The suspension unit includes a damper 84 and a plurality of elastic suspension members 86. The damper 84 supports the washing tub unit 30 while allowing a desired displacement of the tub unit 30 within a predetermined range. The elastic suspension members 86 support the washing tub unit 30 within the cabinet 20 while absorbing vibrations of the washing tub unit 30, and allows the washing tub unit 30 to elastically restore its upright position when the tub unit 30 is inclined relative to the vertical axis of the cabinet 20.

The damper 84 of the suspension unit is an annular elastic body. That is, the damper 84 is opened at its center, and is inclined upward at its upper surface 84*a* to meet the edge of the bottom wall 91*a* of the motor housing 91, and is flat at its lower surface coming into contact with the bottom wall 25 of the cabinet 20. This damper 84 supports the washing tub unit 30 while allowing a desired displacement of the tub unit 30 within a predetermined range.

In the second embodiment, each of the elastic suspension members 86 is a coil spring, which is fitted over a first spring seat 81*a* of the bottom wall of the support plate 81 at its upper end, and fitted over a second spring seat 25*a* of the cabinet's bottom wall 25 at its lower end.

Figure 6:
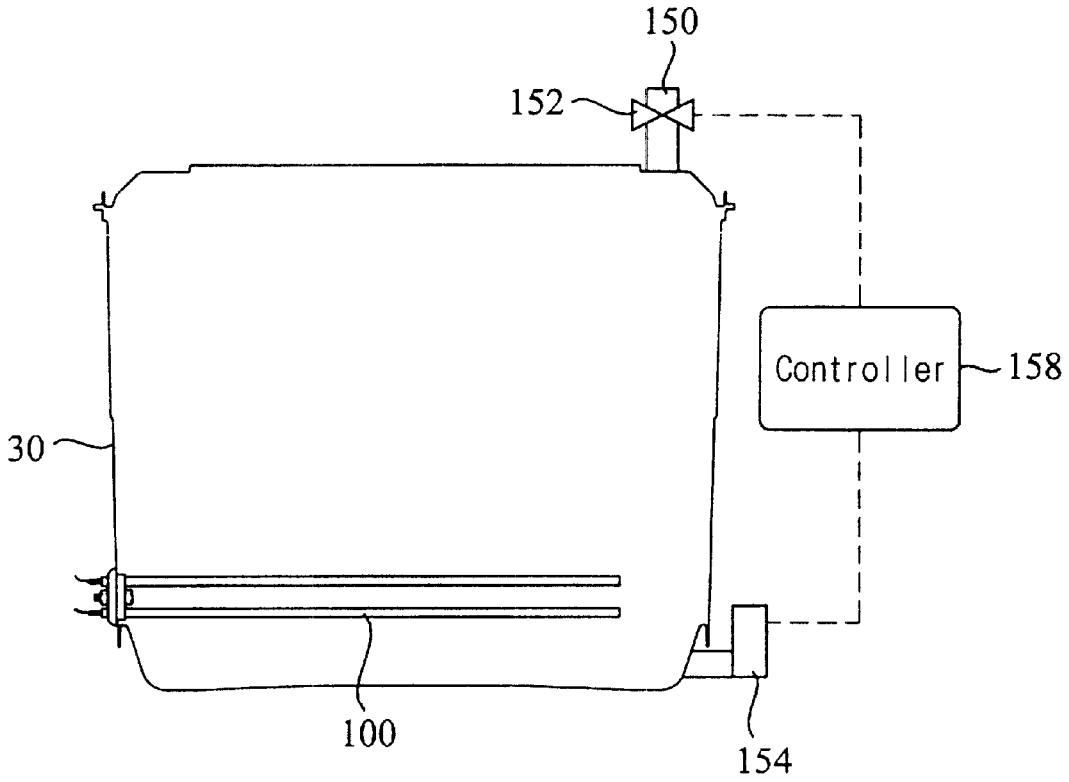
FIG. 6 is a schematic view, showing the construction of a vapor discharging unit included in the drawer-type washing machine in accordance with each of the primary and second embodiments of the present invention.
Figure 7:
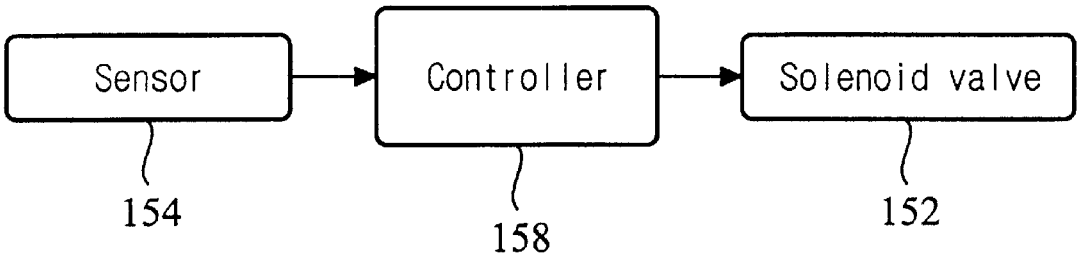
FIG. 7 is a block diagram, showing the construction of a control unit for controlling the vapor discharging unit of FIG. 6.

FIG. 6 is a schematic view, showing the construction of a vapor discharging unit included in the drawer-type washing machine in accordance with each of the primary and second embodiments of this invention. FIG. 7 is a block diagram, showing the construction of a control unit for controlling the vapor discharging unit of FIG. 6.

As shown in FIGS. 6 and 7, the drawer-type washing machine according to each of the primary and second embodiments may be provided with a water heating function for improving the cleaning effect. In order to accomplish the water heating function for improving the cleaning effect, a heater 100 is installed at the sidewall of the washing tub unit 30 such that it is exposed inside the tub unit 30. In such a case, it is necessary to exhaust vapor from the interior of the washing tub unit 30 to the atmosphere, and regulate the pressure inside the tub unit 30 to protect the washing machine from excessive pressure during a water heating process. This object is accomplished by a vapor discharging unit. This vapor discharging unit includes a sensor 154 that is installed at the sidewall of the washing tub unit 30 to sense the water level within the washing tub unit 30, in addition to sensing the pressure inside the tub unit 30. A vapor exhaust port 150 is mounted to the top of the washing tub unit 30 such that the port 150 communicates with the interior of the tub unit 30, thus selectively discharging vapor from the tub unit 30 to the atmosphere as desired. A solenoid valve 152 is mounted to the vapor exhaust port 150, and controls the port 150. The operation of the vapor discharging unit is controlled by a controller 158, which controls the solenoid valve 152 in response to pressure of the washing tub unit 30 sensed by the sensor 154.

The sensor 154 senses the pressure of the tub unit 30, thus being so-called "pressure sensor". However, this sensor 154 also senses the water level inside the tub unit 30 in response to a difference in pressure of the tub unit 30. Thus, this sensor 154 may be also so-called "water level sensor". In a brief description, the sensor 154 senses the water level and the pressure inside the washing tub unit 30 at the same time.

The above sensor 154 senses the atmospheric pressure inside the tub unit 30 at the start of the operation of the washing machine, and senses pressure induced by pressure head inside the tub unit 30, thus sensing the water level within the tub unit 30. When the heater 100 heats the water inside the closed tub unit 30 during a water heating process of improving the cleaning effect, the sensor 154 senses vapor pressure formed by both the vaporization of water and the expansion of vapor inside the tub unit 30, and outputs a pressure signal to the controller 158.

The solenoid valve 152 normally closes the vapor exhaust port 150, but selectively opens the port 150 in response to a control signal output from the controller 158 when the pressure inside the tub unit 30 is higher than a predetermined pressure level.

The operational effect of the vapor discharging unit included in the drawer-type washing machine of this invention will be described herein below.

Figure 8:
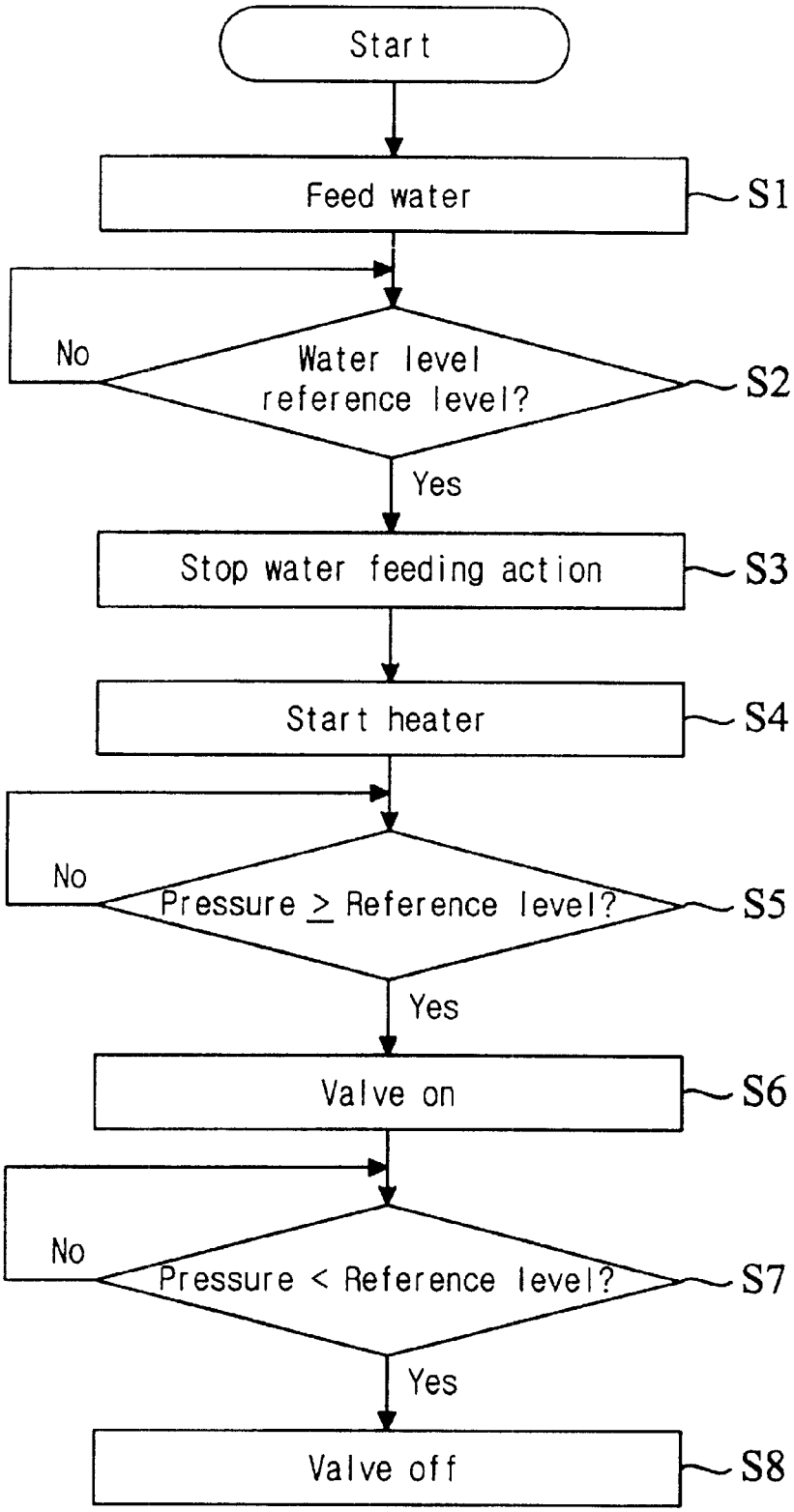
FIG. 8 is a flowchart of a vapor discharging process performed by the vapor discharging unit of FIG. 6.

FIG. 8 is a flowchart of a vapor discharging process performed by the vapor discharging unit.

As shown in the drawing, when water is fed into the washing tub unit 30 at step S1 after the washing machine is turned on, the sensor 154 senses the atmospheric pressure inside the tub unit 30 at the start of the operation of the washing machine, and senses pressure induced by pressure head inside the tub unit 30 to determine whether water inside the tub unit 30 has reached a preset reference level at step S2. When it is determined that the water has reached the reference level, the controller 158 stops the water feeding action at step S3. Thereafter, the heater 100 is turned on at step S4 to heat the water inside the tub unit 30.

At step S5, the controller 158 compares the pressure of the tub unit 30 indicated by a signal output from the sensor 154 with a preset reference level to determine whether the pressure has been increased equal to or higher than the reference level. When the pressure of the tub unit 30 has been increased equal to or higher than the reference level, the controller 158 activates the solenoid valve 152 at step S6 to open the vapor exhaust port 150 and discharge vapor from the tub unit 30 to the atmosphere. At step S7, the controller 158 compares the pressure of the tub unit 30 indicated by a signal output from the sensor 154 with the preset reference level to determine whether the pressure has been reduced lower than the reference level. When the pressure of the tub unit 30 has been reduced lower than the reference level, the controller 158 turns off the solenoid valve 152 at step S8 to close the vapor exhaust port 150.

Figure 9:
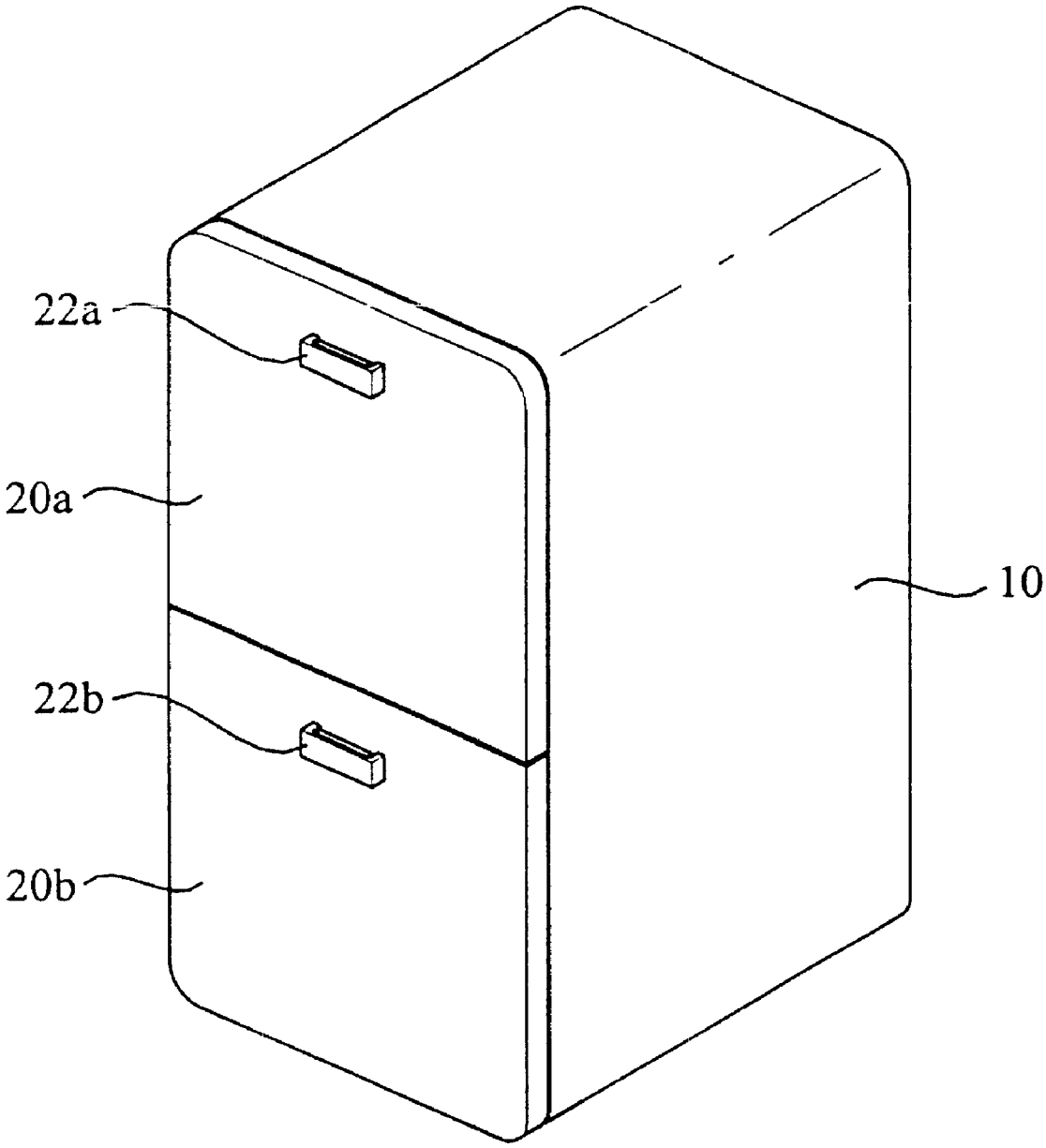
FIG. 9 is a perspective view, showing the appearance of a drawer-type washing machine in accordance with the third embodiment of the present invention.
Figure 10:
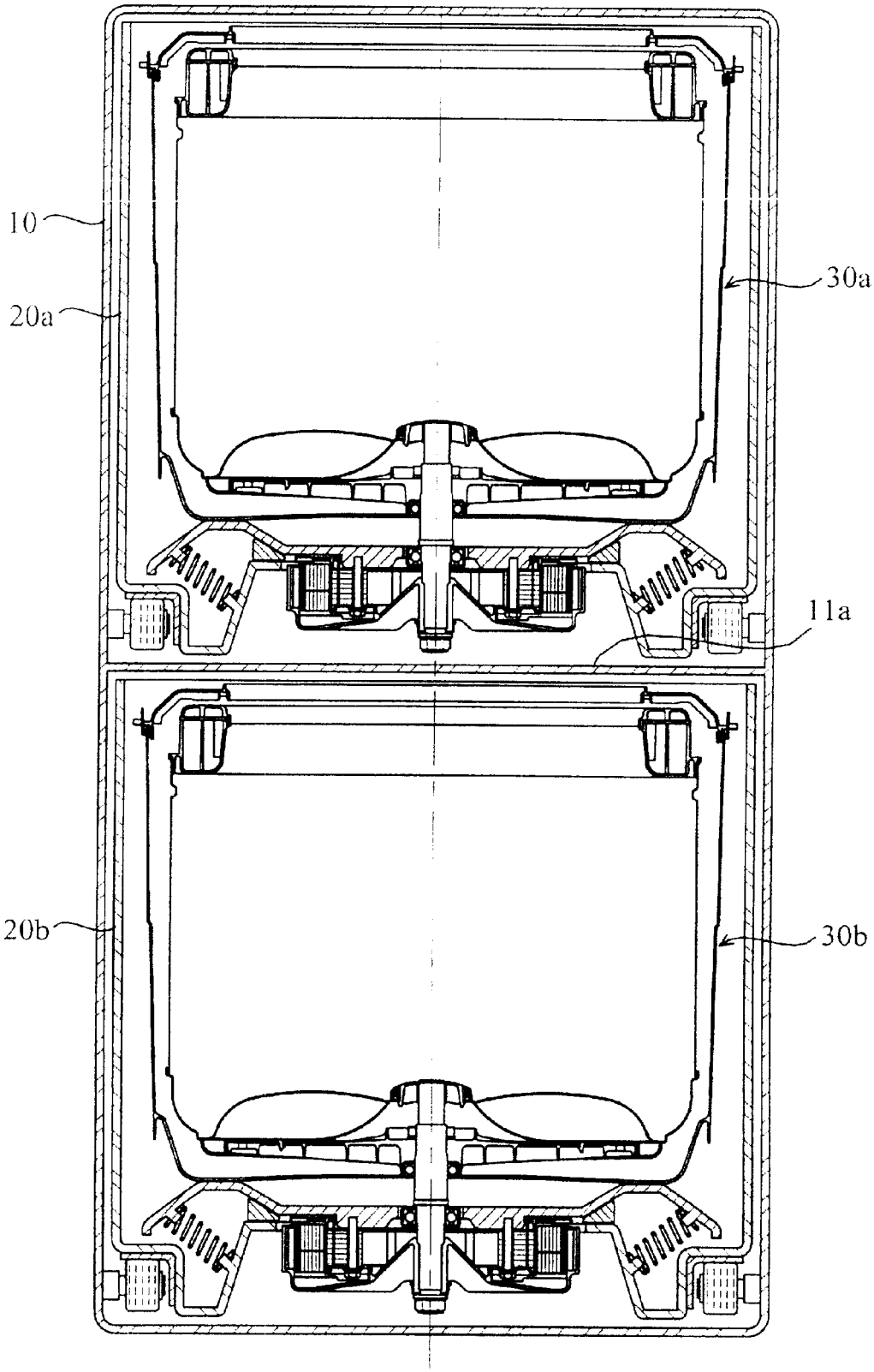
FIG. 10 is a sectional view, showing the construction of the drawer-type washing machine of FIG. 9.

FIGS. 9 and 10 show a drawer-type washing machine in accordance with the third embodiment of the present invention.

As shown in the drawings, the interior of the housing 10 of this washing machine is partitioned into two cavities: upper and lower cavities, by a partition wall 11*a* horizontally extending at the middle portion of the housing 10. Two cabinets 20*a* and 20*b*, each having a handle 22*a* or 22*b* at its front wall and opened at its top, are received in the two cavities of the housing 10 respectively such that each cabinet 20*a* or 20*b* is movable forward or backward relative to the housing 10. A washing tub unit 30*a* or 30*b*, consisting of an outer tub and a perforated inner tub, is set within each of the two cabinets 20. The constructions of each cabinet 20*a* or 20*b*, each washing tub unit 30*a* or 30*b*, and the drive unit for each tub unit 30*a* or 30*b* remain the same as those of the primary embodiment, and further explanation is thus not deemed necessary.

Figure 11:
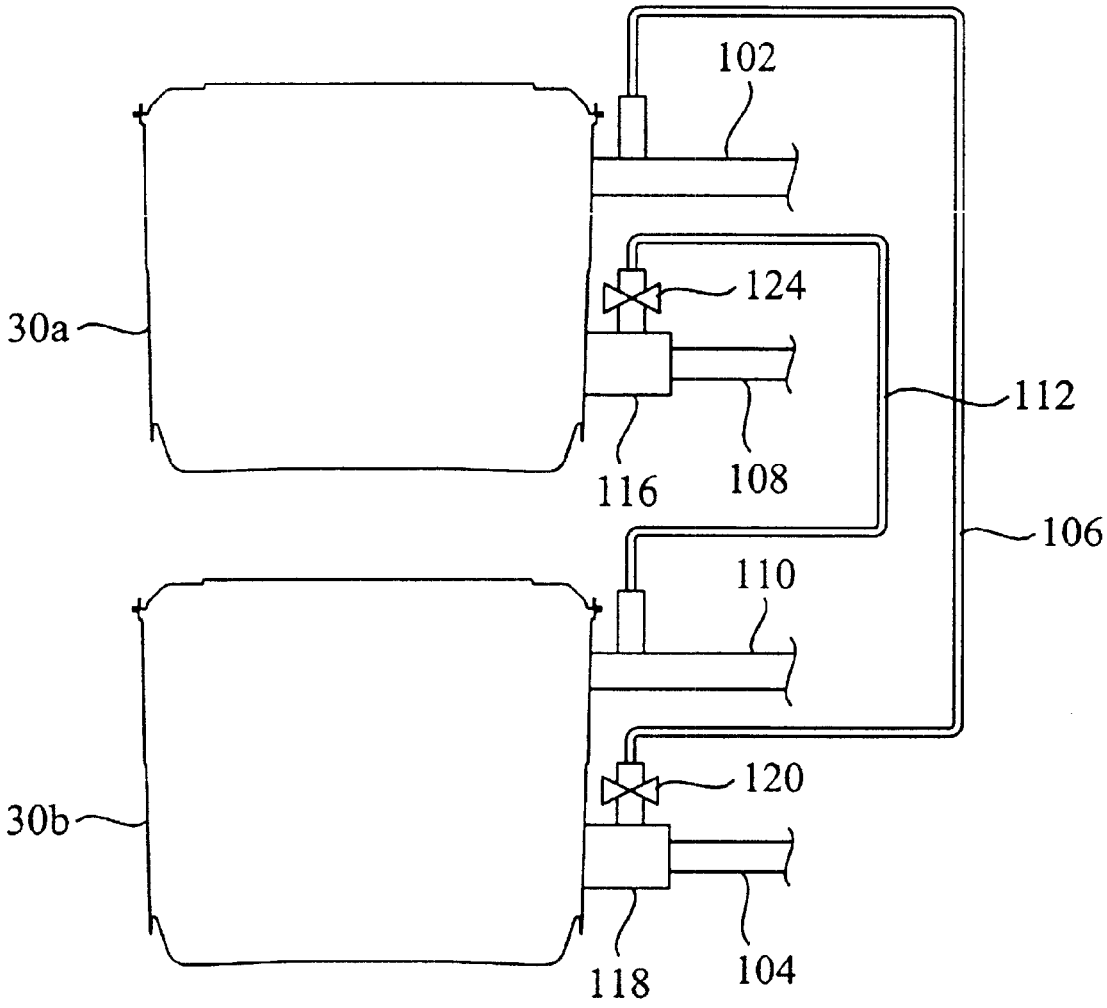
FIG. 11 is a sectional view, showing the construction of a water feeding and draining unit included in the drawer-type washing machine of FIG. 9.
Figure 12:
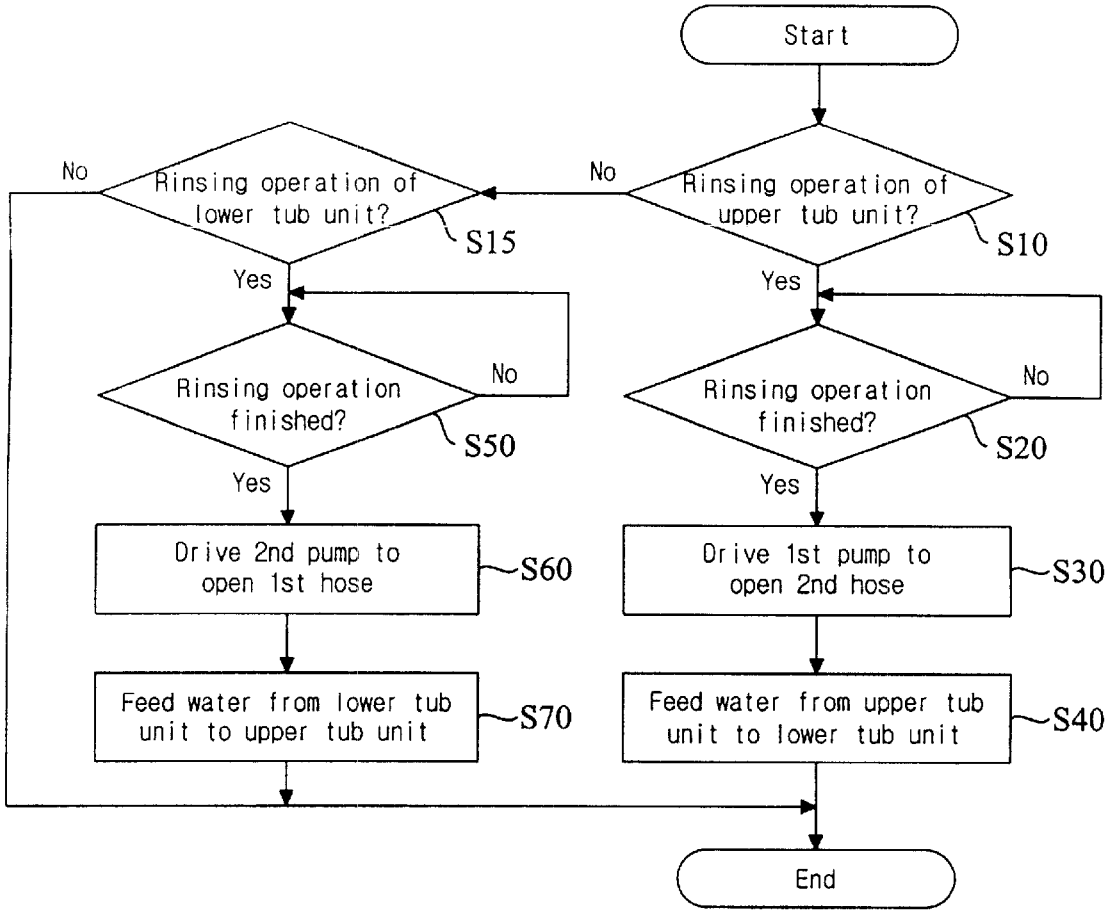
FIG. 12 is a flowchart of a water feeding and draining process performed by the water feeding and draining unit of FIG. 11.

FIG. 11 shows a water feeding and draining unit included in the drawer-type washing machine of FIG. 9. FIG. 12 is a flowchart of a water feeding and draining process performed by the water feeding and draining unit of FIG. 11.

As shown in FIG. 11, the water feeding and draining unit has first and second water feeding pipes 102 and 110 for feeding water to the upper and lower washing tub units 30*a* and 30*b* respectively. First and second water draining pipes 108 and 104 extend from the upper and lower washing tub units 30*a* and 30*b* respectively to drain waste water from the two tub units 30*a* and 30*b* to the atmosphere. A first connection hose 106 connects the second water draining pipe 104 to the first water feeding pipe 102, while a second connection hose 112 connects the first water draining pipe 108 to the second water feeding pipe 110. A first pump 116 is mounted at the junction of the first water draining pipe 108 and the second connection hose 112, and is used as a first flow control device for selectively draining water from the upper washing tub unit 30*a* through the first water draining pipe 108 or the second connection hose 112. A second pump 118 is mounted at the junction of the second water draining pipe 104 and the first connection hose 106, and is used as a second flow control device for selectively draining water from the lower washing tub unit 30*b* through the second water draining pipe 104 or the first connection hose 106.

A first check valve 120 is mounted to the first connection hose 106 to exclusively allow a flow of water inside the first connection hose 106 in a direction from the second water draining pipe 104 to the first water feeding pipe 102. A second check valve 124 is mounted to the second connection hose 112 to exclusively allow a flow of water inside the second connection hose 112 in a direction from the first water draining pipe 108 to the second water feeding pipe 110.

The first pump 116 controls the flow of water discharged from the upper washing tub unit 30*a* so as to selectively drain the water through the first water draining pipe 108 or the second connection hose 112. The flowing direction of the water discharged from the upper washing tub unit 30*a* is controlled by a rotating direction of the first pump 116. For example, the pump 116 discharges water from the tub unit 30*a* through the second connection hose 112 when it is rotated in a forward direction. However, when the pump 116 is rotated in a reverse direction, its drains the water from the tub unit 30*a* through the first water draining pipe 108.

In the same manner as that described for the first pump 116, The second pump 118 controls the flow of water discharged from the lower washing tub unit 30*b* so as to selectively drain the water through the second water draining pipe 104 or the first connection hose 106. The construction of the second pump 118 remains the same as that of the first pump 116.

The water feeding and draining process performed by the above-mentioned water feeding and draining unit will be described herein below with reference to FIGS. 11 and 12.

As shown in the drawings, the upper and lower washing tub units 30*a* and 30*b* are operated at different times such that any one of the two tub units 30*a* and 30*b* is started prior to the other unit. During such an operation of the two tub units 30*a* and 30*b* at different times, the controller determines at step S10 whether the upper tub unit 30*a* is in its rinsing operation, and determines at step S20 whether the rinsing operation of the upper tub unit 30*a* has been finished. When the rinsing operation of the upper washing tub unit 30*a* has been finished, the first pump 116 is controlled such that the drain port of the upper tub unit 30*a* communicates with the second connection hose 112 at step S30, thus feeding the processed water from the rinsing operation of the upper tub unit 30*a* to the lower tub unit 30*b* through the second connection hose 112 at step S40.

When the controller at step S10 determines that the upper tub unit 30*a* is not in its rinsing operation, the controller determines at step S15 whether the lower washing tub unit 30*b* is in its rinsing operation. When it is determined that the lower washing tub unit 30*b* has been in its rinsing operation, the controller determines at step S50 whether the rinsing operation of the lower tub unit 30*b* has been finished. When the rinsing operation of the lower tub unit 30*b* has been finished, the second pump 118 is controlled such that the drain port of the lower tub unit 30*b* communicates with the first connection hose 106 at step S60, thus feeding the processed water from the rinsing operation of the lower tub unit 30*b* to the upper tub unit 30*a* through the first connection hose 106 at step S70.

As described above, the present invention provides a drawer-type washing machine. The washing machine has a linearly movable cabinet, which contains a washing tub unit therein and is designed to be drawn forward and pushed backward in the same manner as that of a conventional drawer, thus allowing a user to easily put laundry into or take laundry out of the washing tub unit. The washing machine of this invention is also easily installed on a desired area without being critically limited by the vertical space above the top of the washing machine, thus allowing a user to use the space above the washing machine for another purpose.

In an embodiment of this invention, the drawer-type washing machine has upper and lower washing tub units, and so a user is allowed to separately wash several groups of laundries, classified in accordance with their fabric characteristics and colors, through a single washing operation cycle, in addition to saving time during a washing process. This washing machine is thus improved in its washing effect.

The washing machine of this invention is also designed to feed processed water from a rinsing operation of any one of the upper and lower washing tub units to the other washing tub unit, thus reusing the water to conserve water, in addition to being less likely to cause environmental pollution, particularly, water pollution.

The drawer-type washing machine of this invention is also designed to automatically discharge vapor from the interior of the washing tub unit when pressure inside the washing tub unit is increased higher than a reference level, thus preventing unexpected breakage of the washing tub unit due to excessive pressure.

The present invention also provides a process of washing laundry using such a drawer-type washing machine.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A drawer-type washing machine, comprising:

a housing opened at its front to form a cavity;

a cabinet opened at its top and received in the cavity of said housing such that the cabinet is movable forward or backward relative to the housing;

a washing tub unit consisting of an outer tub and an inner tub, and set within the cabinet, said washing tub unit containing washing water therein, and carrying out both a washing operation and a spin-drying operation for laundry contained therein;

a drive unit installed at a position under the outer tub of said washing tub unit, and rotating the inner tub of the washing tub unit;

a suspension unit used for supporting the washing tub unit within said cabinet while performing a damping function of attenuating operational vibrations of the washing tub unit; and a sliding unit provided at a movable junction of the housing and the cabinet for allowing a linear sliding movement of the cabinet relative to the housing.

2. The drawer-type washing machine according to claim 1, wherein said washing tub unit is covered with an openable cover its top opening.

3. The drawer-type washing machine according to claim 1, wherein a support plate is externally mounted to a bottom wall of said outer tub, with the drive unit being mounted to a lower surface of said support plate, and the suspension unit being provided between said support plate and a bottom wall of said housing.

4. The drawer-type washing machine according to claim 3, wherein said drive unit comprises:

a stator mounted to the lower surface of said support plate, with a coil wound around the stator;

a rotor arranged around said stator;

a rotor core holding said rotor; and a drive shaft fitted into and fixed to a center of said rotor core at its lower end, and rotatably passing through both the support plate and the outer tub prior to being mounted to the inner tub at its upper end.

5. The drawer-type washing machine according to claim 3, wherein said suspension unit includes a damper positioned between the support plate and the bottom wall of said cabinet, and supporting the washing tub unit within said cabinet while allowing a displacement of the washing tub unit within a predetermined range.

6. The drawer-type washing machine according to claim 5, wherein said damper is opened at its center, and is inclined upward at its upper surface to meet an upward and outward inclined surface of said support plate, and is flat at its lower surface, said damper being positioned on the bottom wall of the cabinet such that the damper is movable relative to the bottom wall of the cabinet within a predetermined range.

7. The drawer-type washing machine according to claim 3, wherein said suspension unit includes a plurality of elastic suspension members positioned between the support plate and the bottom wall of the cabinet, said elastic suspension members supporting the washing tub unit within the cabinet while absorbing vibrations of the washing tub unit and allowing the washing tub unit to elastically restore its upright position when the washing tub unit is inclined relative to a vertical axis of the cabinet.

8. The drawer-type washing machine according to claim 7, wherein each of said elastic suspension members is a coil spring seated on an inclined surface formed at an edge of said support plate and an inclined surface formed on the bottom wall of said cabinet at its opposite ends.

9. The drawer-type washing machine according to claim 8, wherein each of said coil spring is seated on a first spring seat of the support plate at its upper end, and is seated on a second spring seat of the bottom wall of said cabinet at its lower end.

10. The drawer-type washing machine according to claim 1, wherein said sliding unit comprises:

two guide rails extending from the front to the back along opposite side edges of the cabinet's bottom wall; and a plurality of rollers rotatably mounted to lower portions of interior surfaces of opposite sidewalls of said housing, and rotatably supporting said rails thereon, thus allowing the cabinet to be movable forward or backward relative to the housing.

11. The drawer-type washing machine according to claim 1, wherein said drive unit comprises:

a motor housing mounted to a lower surface of the support plate;

a stator mounted to an inner surface of a sidewall of said motor housing, with a coil wound around said stator;

a rotor arranged inside said stator while being regularly spaced apart from an inside edge of said stator;

a rotor core holding said rotor; and a drive shaft fitted into and fixed to said rotor core, said drive shaft also rotatably penetrating the bottom wall of the motor housing at its lower end, and rotatably penetrating the support plate and the outer tub at its middle portion, and mounted to the bottom wall of said inner tub at its upper end.

12. The drawer-type washing machine according to claim 11, wherein said suspension unit includes a damper, opened at its center and inclined at its upper surface to meet an edge of the bottom wall of said motor housing, said damper being laid on the bottom wall of said cabinet to support the washing tub unit while allowing a displacement of the washing tub unit within a predetermined range.

13. The drawer-type washing machine according to claim 11, wherein said suspension unit includes a plurality of elastic suspension members positioned between the lower surface of said support plate and the bottom wall of said cabinet, said elastic suspension members supporting the washing tub unit within the cabinet while absorbing vibrations of the washing tub unit and allowing the washing tub unit to elastically restore its upright position when the washing tub unit is inclined relative to a vertical axis of the cabinet.

14. The drawer-type washing machine according to claim 1, wherein the interior of said housing is partitioned into two or more cavities by at least one partition wall, with two or more cabinets each having a washing tub unit therein and respectively received in the two or more cavities of said housing.

15. The drawer-type washing machine according to claim 14, wherein the interior of said housing is partitioned into upper and lower cavities by a horizontal partition wall, thus receiving upper and lower cabinets in the upper and lower cavities respectively.

16. The drawer-type washing machine according to claim 15, further comprising:

a first water feeding pipe used for feeding water to an upper washing tub unit received in the upper cabinet;

a first water draining pipe used for draining water from said upper washing tub unit;

a second water feeding pipe used for feeding water to a lower washing tub unit received in the lower cabinet;

a second water draining pipe used for draining water from said lower washing tub unit;

a first connection hose connecting the second water draining pipe to the first water feeding pipe;

a second connection hose connecting the first water draining pipe to the second water feeding pipe;

a first flow control device for selectively draining processed water from a rinsing operation of the upper washing tub unit to the atmosphere through the first water draining pipe or feeding the processed water from the upper washing tub unit to the lower washing tub unit through the second connection hose; and a second flow control device for selectively draining processed water from a rinsing operation of the lower washing tub unit to the atmosphere through the second water draining pipe or feeding the processed water from the lower washing tub unit to the upper washing tub unit through the first connection hose.

17. The drawer-type washing machine according to claim 16, wherein each of said first and second flow control devices is a pump.

18. The drawer-type washing machine according to claim 1, further comprising:

a pressure sensor used for sensing pressure inside the washing tub unit;

a vapor exhaust port mounted to the top of said washing tub unit such that the port communicates with the interior of said washing tub unit, thus selectively discharging vapor from the washing tub unit to the atmosphere;

a solenoid valve mounted to the vapor exhaust port and used for controlling said port; and a controller used for controlling the solenoid valve to open said vapor exhaust port when the pressure of the washing tub unit sensed by said pressure sensor is equal to or higher than a reference level.

19. A process of washing laundry using a drawer-type washing machine, with first and second cabinets respectively containing first and second washing tub units and set in a housing to be movable forward or backward relative to said housing, comprising:

a first step of determining whether the first washing tub unit is in its rinsing operation;

a second step of determining whether the rinsing operation of the first washing tub unit has been finished when it is determined at the first step that the first washing tub unit is in its rinsing operation, and a third step of feeding processed water from the rinsing operation of the first washing tub unit to the second washing tub unit when it is determined at the second step that the rinsing operation of the first washing tub unit has been finished;

a fourth step of determining whether the second washing tub unit is in its rinsing operation when it is determined at the first step that the first washing tub unit is not in its rinsing operation;

a fifth step of determining whether the rinsing operation of the second washing tub unit has been finished when it is determined at the fourth step that the second washing tub unit is in its rinsing operation; and a sixth step of feeding processed water from the rinsing operation of the second washing tub unit to the first washing tub unit when it is determined at the fifth step that the rinsing operation of the second washing tub unit has been finished.

20. A process of washing laundry using a drawer-type washing machine, comprising the steps of:

sensing pressure induced by pressure head inside a washing tub unit after water is fed into said washing tub unit, and determining whether water inside the washing tub unit has reached a reference level;

turning on a heater to heat the water inside the washing tub unit when it is determined that the water has reached the reference level;

determining whether the pressure inside the washing tub unit has been increased equal to or higher than a reference level;

discharging highly pressurized vapor from said washing tub unit to the atmosphere when it is determined that the pressure inside the washing tub unit has been increased equal to or higher than the reference level;

determining whether the pressure inside the washing tub unit has been reduced lower than the reference level; and stopping the vapor discharging action when it is determined that the pressure inside the washing tub unit has been reduced lower than the reference level.

* * * * *